US005312796A

United States Patent [19]

Nishimura et al.

[11] Patent Number: 5,312,796

[45] Date of Patent: May 17, 1994

[54] THERMOSENSITIVE RECORDING MATERIAL

[75] Inventors: Masaki Nishimura, Tokyo; Kunitaka Toyofuku, Sakura, both of Japan

[73] Assignee: Oji Paper Co., Ltd., Tokyo, Japan

[21] Appl. No.: 882,873

[22] Filed: May 14, 1992

[30] Foreign Application Priority Data

May 20, 1991 [JP] Japan ..... 3-114906
Jun. 1, 1991 [JP] Japan ..... 3-130102

[51] Int. Cl.[5] ..... B41M 5/30

[52] U.S. Cl. ..... 503/209; 503/216; 503/225

[58] Field of Search ..... 503/216, 209, 225

[56] References Cited

U.S. PATENT DOCUMENTS 3,539,375 11/1970 Baum ..... 117/36.2

FOREIGN PATENT DOCUMENTS 434160 2/1943 Japan .
45-14039 5/1970 Japan .
4827736 4/1973 Japan .
56-146794 11/1981 Japan .
58-199189 11/1983 Japan .
59-93387 5/1984 Japan .
59-114096 6/1984 Japan .
59-167292 9/1984 Japan .
60-78782 5/1985 Japan .
60-219088 11/1985 Japan .
62-164579 7/1987 Japan .

OTHER PUBLICATIONS

Patent Abstracts of Japan, vol., 9 No. 226 (M-412) (1949), Sep. 12, 1985.
Patent Abstracts of Japan, vol. 6, No. 199 (M-162) (1077), Oct. 8, 1982.

*Primary Examiner*—Pamela R. Schwartz
*Attorney, Agent, or Firm*—Armstrong, Westerman, Hattori, McLeland & Naughton

[57] ABSTRACT

A thermosensitive recording material having a high whiteness and capable of forming thereon colored images having an excellent oil and plasticizer resistance and persistency over a long time, comprises a thermosensitive colored image forming layer formed on a sheet substrate and comprising, together with a dye precursor and a binder, a color-developing agent comprising at least one compound of the formulae (I) to (VIII).

$$CH_2{=}C(CH_3)CONHCONHCO{-}R_1 \quad (I)$$

$$CH_2{=}C(CH_3)CONHCO{-}S{-}R_1 \quad (II)$$

$$CH_2{=}C(CH_3)CONHCOON{=}C(R_3){-}R_2 \quad (III)$$

$$CH_2{=}C(CH_3)CONHCO{-}O{-}R_4 \quad (IV)$$

$$CH_2{=}C(CH_3)CONHCO{-}N(R_6){-}R_5 \quad (V)$$

$$R_7{-}CONHCO{-}R_8 \quad (VI)$$

$$R_9{-}CONHCO{-}O{-}R_{10} \quad (VII)$$

and $$R_{10}{-}CONNCO{-}N(R_{11}){-}R_{12} \quad (VIII)$$

wherein $R_1$=H, alkyl, aryl, aralkyl, alkenyl or cycloalkyl, $R_2$ and $R_3$=H, alkyl, aryl aralkyl, alkenyl or acetyl, or are fuse-bonded to form a cyclic structure, $R_4$=alkyl, aryl, aralkyl, alkenyl, piperidino, succinimide, *p*-benzylphenyl, etc., $R_5$ and $R_6$=H, alkyl, aryl, aralkyl, alkenyl cycloalkyl, etc., or are fuse-bonded to form $R_7$, $R_9$, and $R_{11}$=unsubstituted or substituted aromatic groups with alkyl, alkoxyl, acyl, etc., $R_8$, $R_{10}$ and $R_{12}$=unsubstituted or substituted alkyl, aryl, aralkyl or alkenyl with alkyl, alkoxyl, acyl, nitro or halogen, and $R_{13}$=H or unsubstituted or substituted alkyl, aryl aralkyl or alkenyl with alkyl, alkoxyl, acyl, nitro or halogen.

6 Claims, No Drawings

THERMOSENSITIVE RECORDING MATERIAL

BACKGROUND OF THE INVENTION

Field of the Invention

The present invention relates to a thermosensitive recording material on which colored images are formed by heating. More particularly, the present invention relates to a thermosensitive recording material capable of forming thereon colored images having a high persistency for a record storage thereof for a long time.

The thermosensitive recording material of the present invention is able to record thereon colored images exhibiting an excellent resistance to fading caused by moisture, heat, oily and fatty substances, and plasticizers, and thus has a superior stability when stored for a long time, and therefore is useful as colored image-recording sheets, sheets for use in facsimiles, word processors, CRT image printers and cash dispensers, as passenger tickets, commuter's passes, labels such as POS labels, cards such as prepaid cards, and as transit passes.

Description of the Related Arts

It is known that a conventional thermosensitive recording material comprises a supporting substrate, for example, a paper sheet, synthetic paper sheet, or plastic resin film, and a thermosensitive colored image-forming layer formed on a surface of the supporting substrate and comprising an electron-donative dye precursor, for example, a leuco basic dye, an electron-acceptive color-developing agent consisting of an organic acid substance, for example, a phenolic compound, and a binder. When the thermosensitive colored image-forming layer is heated, colored images are recorded thereon by a reaction of the dye precursor with the color-developing agent.

This type of thermosensitive recording material is disclosed in Japanese Examined Patent Publication Nos. 43-4,160 and 45-14,039 and Japanese Unexamined Patent Publication No. 48-27,736, and is widely employed in practice.

Namely, the thermosensitive recording material is advantageous in that the colored images can be easily formed only by heating, and the recording apparatus can be made relatively compact and small size, has a low cost, and is easily maintained, and thus is useful as an information-recording material for various outputs or printers used with, for example, computers, facsimile machines, automatic ticket-vending machines, scientific measurement recorders, and CRT medical measurement recorders.

Nevertheless, the conventional dye-forming type thermosensitive recording materials in which the thermosensitive colored image-forming layer comprises a conventional color-developing agent together with the dye precursor and the binder, is disadvantageous in that the reaction of the dye precursor with the color-developing agent is reversible, and thus the resultant colored images fade with a lapse of time. This fading of the colored images is accelerated by exposure to light, high temperatures and high humidity, and promoted by contact with an oily or fatty substance or a plasticizer, and the colored images fade to an extent such that the faded images cannot be recognized.

Many attempts have been made to inhibit the color-fading of the colored images formed on the conventional thermosensitive colored image-forming layer containing a substantially colorless dye precursor comprising a lactone ring compound.

For example, Japanese Unexamined Patent Publication Nos. 60-78,782, 59-167,292, 59-114,096 and 59-93,387 disclose a thermosensitive colored image-forming layer containing a phenolic antioxidant.

Japanese Unexamined Patent Publication No. 56-146,794 discloses a protective layer formed from a hydrophobic polymeric compound emulsion on a thermosensitive colored image-forming layer.

Japanese Unexamined Patent Publication No. 58-199,189 discloses an intermediate layer formed from a water-soluble polymeric compound or a hydrophobic polymeric compound emulsion on a thermosensitive colored image-forming layer, and a surface layer formed from an oil coating liquid comprising, as a resin component, a hydrophobic polymer on the intermediate layer.

Japanese Unexamined Patent Publication No. 62-164,579 and 60-219,088 disclose a thermosensitive colored image-forming layer containing an additive consisting of an epoxy compound and/or an aziridine compound.

In the above-mentioned thermosensitive colored image-forming layer containing the phenolic antioxidant, the resultant colored images exhibit a higher resistance to heat and moisture and a longer persistency in the ambient atmosphere than those of a conventional colored image-forming layer free from the phenolic antioxidant, but the improvement in the storage stability of the resultant colored images is still not satisfactory. Also, the phenolic antioxidant does not effectively enhance the resistance of the colored images to the oily or fatty substances, for example, salad oil and, to the plasticizer, for example, dioctyl phthalate. The resistance of the colored images to oily or fatty substance or plasticizer is determined in such a manner that an oily or fatty substance, for example, a salad oil, or a plasticizer, for example, dioctyl phthalate, is brought into contact with colored images, the colored images are left in contact with the oily or fatty substance or the plasticizer for a predetermined time, and then a retention of the color density of the tested colored images is measured in comparison with an initial color density thereof.

When the protective layer or the intermediate and surface layers are formed on the thermosensitive colored image-forming layer, the resultant colored images have a satisfactory resistance to the oily and fatty substances and to the plasticizers, and exhibit a significantly enhanced storage persistency when the salad oil or the dioctyl phthalate is brought into contact with the colored image-forming surface of the recording material. Nevertheless, when the salad oil or the dioctyl phthalate is brought into contact with an edge face or a back surface of the recording material, it penetrates into the inside of the recording material and causes the colored images to be substantially completely faded. Therefore, the provision of the protecting layer or the intermediate and surface layer cannot completely eliminate the undesirable color-fading of the colored images.

The addition of the epoxy compound and/or aziridinyl compound to the colored image-forming layer is unsatisfactory in that it takes a long time to satisfactorily stabilize the colored images formed on the colored image-forming layer by a heat-recording operation, and therefore, if an oily or fatty substance, for example, salad oil or dioctyl phthalate, is brought into contact with the colored image-forming layer immediately after the heat-recording operation, the resultant colored images are faded to a great extent.

SUMMARY OF THE INVENTION

An object of the present invention is to provide a thermosensitive recording material allowing colored images formed thereon to exhibit an excellent resistance to oily and fatty substances and to plasticizers even immediately after the formation of the colored images, and thus a superior persistency over a long time.

Another object of the present invention is to provide a thermosensitive recording material useful for thermorecording type tickets of automatic ticket machines, for commuter's passes, and for coupon tickets, which must have a high persistency, in terms of the quality of the colored images recorded thereon, for a long time, for label sheets in a POS bar code price-indicating system, to be attached to a surface of a polyvinyl chloride film containing a plasticizer and wrapping fresh food or meat containing an oily or fatty substance, which label sheets are unavoidably brought into contact with the plasticizer and/or oily or fatty substance, for facsimile recording sheets and word processor recording sheets which must have a high persistency, and for CRT image printing sheets.

The above-mentioned objects can be attained by the thermosensitive recording material of the present invention, which comprises a sheet substrate, and a thermosensitive colored image-forming layer formed on a surface of the sheet substrate and comprising a substantially colorless dye precursor, a color developing agent reactive with the dye precursor upon heating to thereby develop a color, and a binder, the color-developing agent comprising at least one compound selected from the group consisting of the methacryloylimido compounds of the formulae (I) to (V):

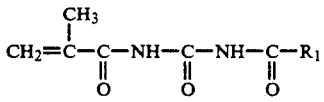
(I)

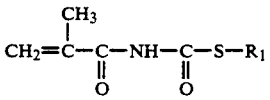
(II)

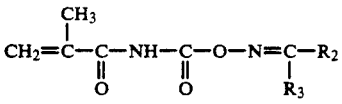
(III)

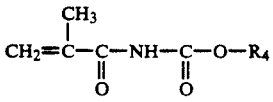
(IV)

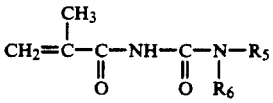
(V)

in which formulae (I) to (V), $R_1$ represents a member selected from the group consisting of a hydrogen atom and alkyl, aryl, aralkyl, alkenyl and cycloalkyl groups; $R_2$ and $R_3$ respectively and independently from each other represent a member selected from the group consisting of a hydrogen atom and alkyl, aryl, aralkyl, alkenyl and acetyl groups, except that when one of $R_2$ and $R_3$ represents a hydrogen atom, the other of $R_2$ and $R_3$ represents a member other than the hydrogen atom, which $R_2$ and $R_3$ may be formed together with a carbon atom bonded thereto into a cyclic structure; $R_4$ represents a member selected from the group consisting of alkyl, aryl, aralkyl, alkenyl, piperidino, succinimido and p-benzoylphenyl groups and the groups of the following formulae:

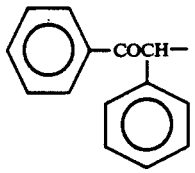

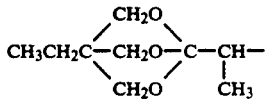

and

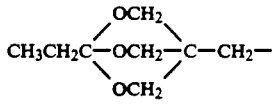

and $R_5$ and $R_6$ respectively and independently from each other represent a member selected from the group consisting of a hydrogen atom and alkyl, aryl, aralkyl, alkenyl, cycloalkyl, thiazolinyl and morpholino groups, which $R_5$ and $R_6$ may be formed together with a nitrogen atom bonded thereto into a cyclic structure selected from the group consisting of

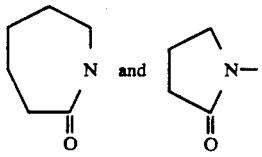

and the aromatic imido compounds of the formulae (VI) to (VIII):

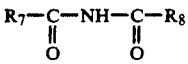
(VI)

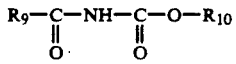
(VII)

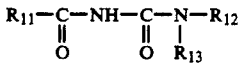
(VIII)

in which formulae (VI) to (VIII), $R_7$, $R_9$ and $R_{11}$ respectively and independently from each other represent a member selected from the group consisting of unsubstituted aromatic cyclic groups and substituted aromatic cyclic groups having at least one substituent selected from the group consisting of alkyl, alkoxyl, acyl, aryl, nitro and carboxylic groups and halogen atoms;

$R_8$, $R_{10}$ and $R_{12}$ respectively and independently from each other represent a member selected from the group consisting of unsubstituted alkyl, aryl, aralkyl and alkenyl groups, and substituted alkyl, aryl, aralkyl and alkenyl groups each having at least one substituent selected from the group consisting of alkyl, alkoxyl, acyl and nitro groups and halogen atoms; and $R_{13}$ represents a member selected from the group consisting of a hydrogen atom, unsubstituted alkyl, aryl, aralkyl and alkenyl groups and substituted alkyl, aryl, aralkyl and alkenyl groups each having at least one substituent selected from the group consisting of alkyl, alkoxyl, acyl and nitro groups and halogen atoms.

DESCRIPTION OF THE PREFERRED EMBODIMENTS

In the thermosensitive recording material of the present invention, a thermosensitive colored image-forming layer is arranged on a surface of a sheet substrate, and comprises a substantially colorless dye precursor, a specific color developing agent reactive with the dye precursor upon heating to thereby develop a color, and a binder.

The specific color developing agent comprises at least one member selected from the group consisting of the specific methacryloylimido compounds of the formulae (I) to (V) and the aromatic imido compounds of the formulae (VI) to (VIII).

The compounds of the formulae (I) to (VIII) have an imido group of the formula:

—CO—NH—CO—

In the specific compounds of the formulae (I) to (VIII), the alkyl groups represented by $R_1$ to $R_6$, $R_8$, $R_{10}$, $R_{12}$ and $R_{13}$ preferably have 1 to 18 carbon atoms and are selected from methyl, ethyl, propyl, butyl, pentyl and octadecyl, the aryl groups represented by $R_1$ to $R_6$, $R_8$, $R_{10}$, $R_{12}$ and $R_{13}$ are preferably selected from phenyl, naphthyl and anthryl groups, the aralkyl groups represented by $R_1$ to $R_6$, $R_8$, $R_{10}$, $R_{12}$ and $R_{13}$ are preferably selected from benzyl, phenethyl and naphthylmethyl, the alkenyl groups represented by $R_1$ to $R_6$, $R_8$, $R_{10}$, $R_{12}$ and $R_{13}$ are preferably selected from propenyl, butenyl and pentenyl, the cycloalkyl groups represented by $R_1$, $R_5$, and $R_6$ are preferably selected from cyclohexyl and cyclopropyl, and the aromatic cyclic groups represented by $R_7$, $R_9$ and $R_{11}$ are preferably selected from benzene, naphthalene, phenanthrene and anthracene ring groups.

Also, in the formulae (VI) to (VIII), the alkyl groups contained, as substituents, in $R_7$ to $R_{13}$ preferably have 1 to 4 carbon atoms and are selected from methyl, ethyl, propyl and butyl, the alkoxyl groups contained, as substituents, in $R_7$ to $7_{13}$ preferably have 1 to 3 carbon atoms and are selected from methoxy, ethoxy and propoxy groups, the acyl groups contained, as substituents, in $R_7$ to $R_{13}$ are preferably selected from acetyl and benzoyl groups, the aryl groups contained, as substituents, in $R_7$, $R_9$ and $R_{11}$ are preferably selected from phenyl and naphthyl, and the halogen atoms contained, as substituents, in $R_7$ to $R_{13}$ are preferably selected from chlorine, bromine and iodine atoms.

Preferably, the methacryloylimido compounds of the formulae 1) to 36):

1)
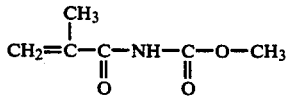
m.p. 94–95° C.

2)
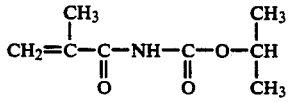
m.p. 108° C.

3)
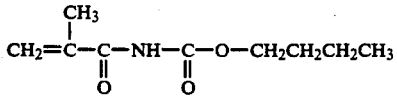
m.p. 91–92° C.

4)
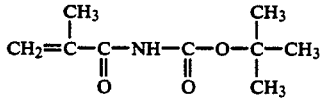
m.p. 160° C.

5)
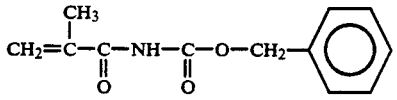
m.p. 109–110° C.

6)
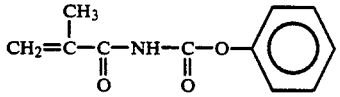
m.p. 94–95° C.

7)
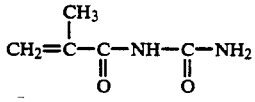
m.p. 137–138° C.

8)
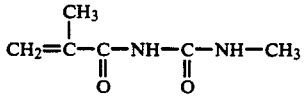
m.p. 112–114° C.

9)
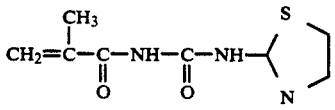
m.p. 166–167° C.

10)
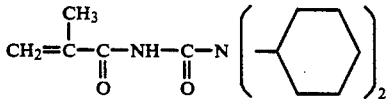
m.p. 166–167° C.

11)
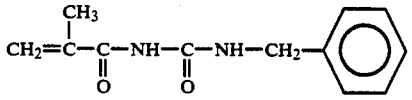
m.p. 97–98° C.

-continued
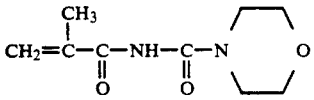
m.p. 104–105° C.
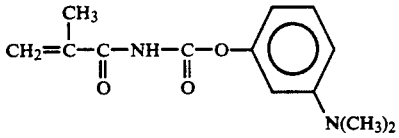
m.p. 107–110° C.
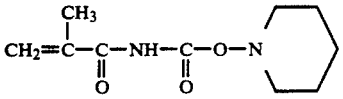
m.p. 84–86° C.
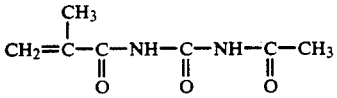
m.p. 92–94° C.
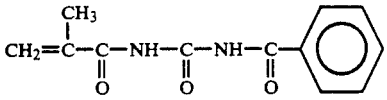
m.p. 160–161° C.
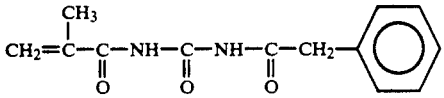
m.p. 115–117° C.
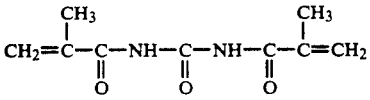
m.p. 130–132° C.
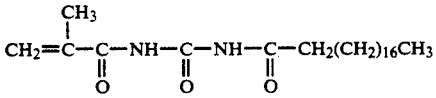
m.p. 86–88° C.
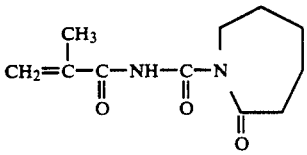
m.p. 89–91° C.
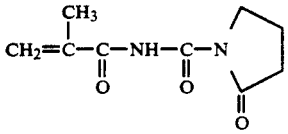
m.p. 106–107° C.
-continued
12) 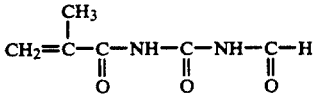
m.p. 102–104° C.
13) 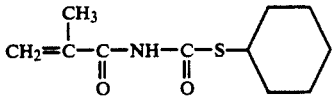
m.p. 81–82° C.
14) 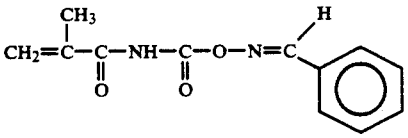
m.p. 121–123° C.
15) 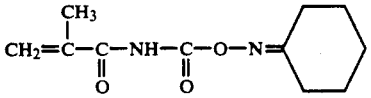
m.p. 86–88° C.
16) 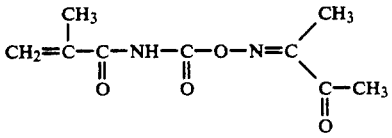
m.p. 85–87° C.
17) 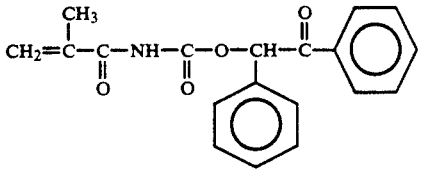
m.p. 161–163° C.
18) 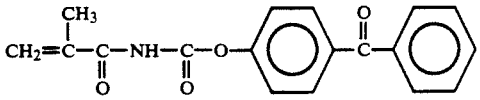
m.p. 96–97° C.
19) 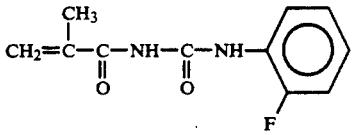
m.p. 155–157° C.
20) 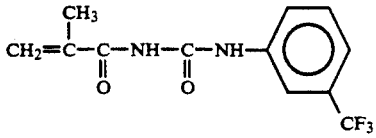
m.p. 155–156° C.
21) 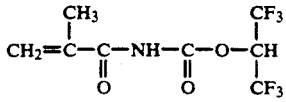
m.p. 113° C.
22) 
m.p. 102–104° C.
23) 
m.p. 81–82° C.
24) 
m.p. 121–123° C.
25) 
m.p. 86–88° C.
26) 
m.p. 85–87° C.
27) 
m.p. 161–163° C.
28) 
m.p. 96–97° C.
29) 
m.p. 155–157° C.
30) 
m.p. 155–156° C.
31) 
m.p. 113° C.

-continued
32)
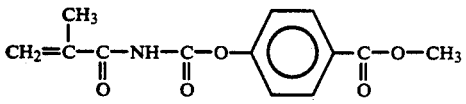
m.p. 98–100° C.
33)
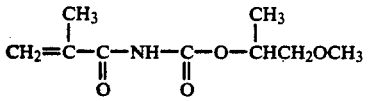
m.p. 84–86° C.
34)
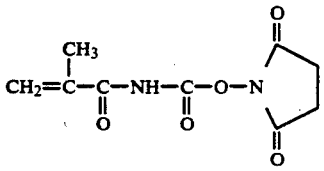
m.p. 119–122° C.
35)
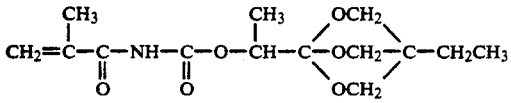
m.p. 146–148° C.
36)
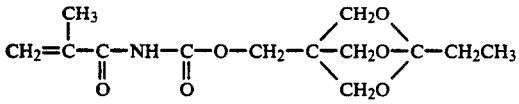
m.p. 106–109° C.
The aromatic imido compounds of the formulae (VI) to (VIII) are preferably selected from the group consisting of the compounds of the formulae 101) to 167):
101)
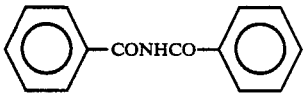
102)
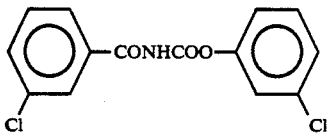
103)
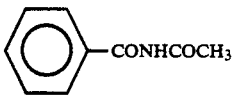
104)
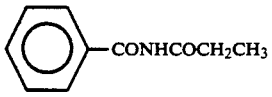
105)
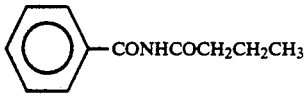
106)
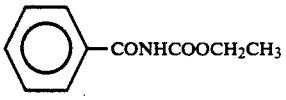
-continued
107)
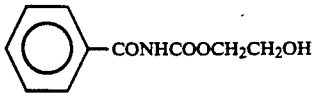
108)
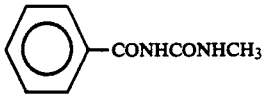
109)
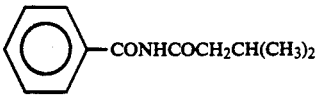
110)
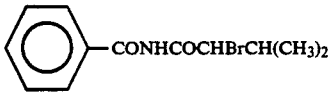
111)
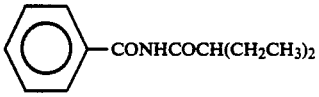
112)
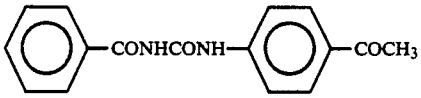
113)
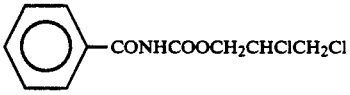
114)
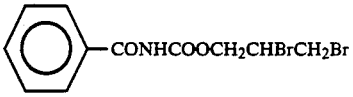
115)
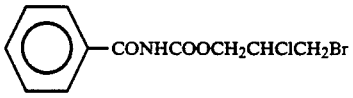
116)
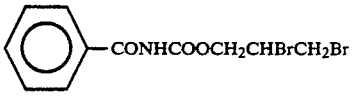
117)
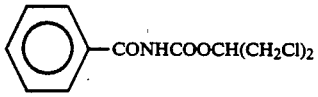
118)
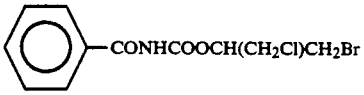
119)
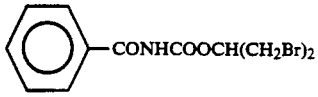
120)
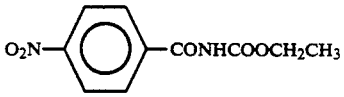

-continued
121)
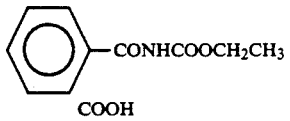
122)
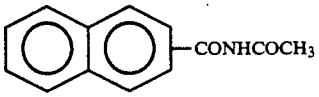
123)
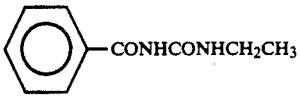
124)
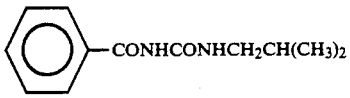
125)
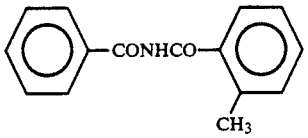
126)
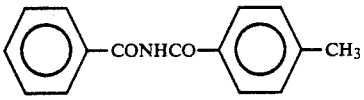
127)
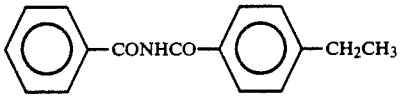
128)
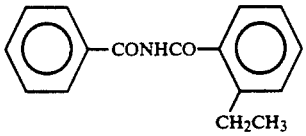
129)
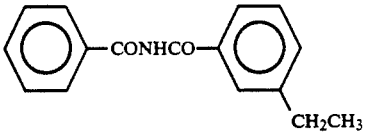
130)
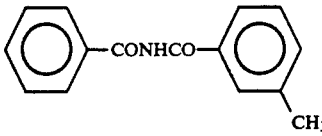
131)
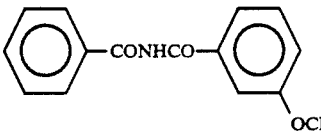
-continued
132)
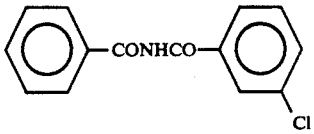
133)
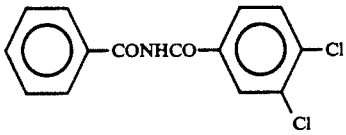
134)
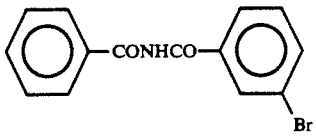
135)
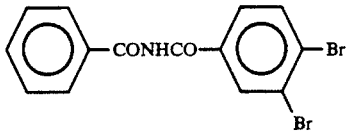
136)
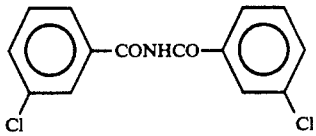
137)
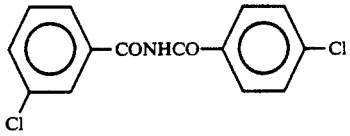
138)
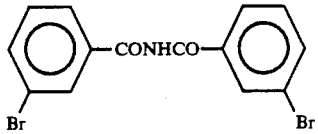
139)
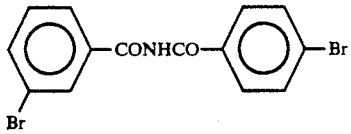
140)
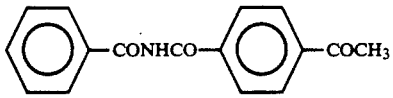
141)
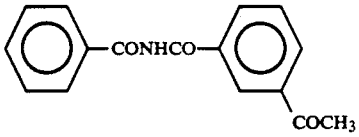
142)
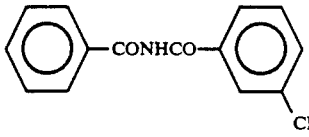

-continued
143)
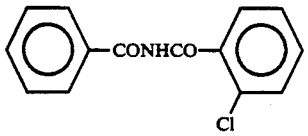
144)
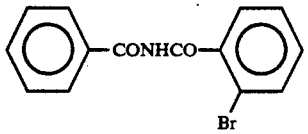
145)
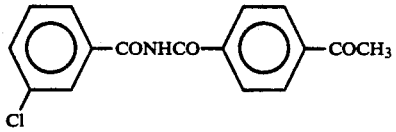
146)
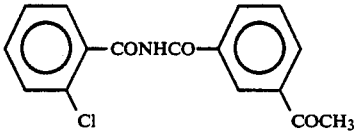
147)
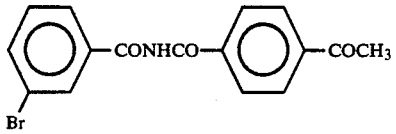
148)
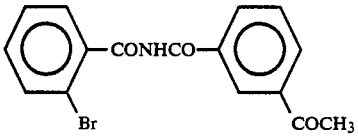
149)
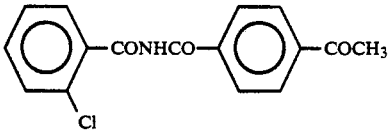
150)
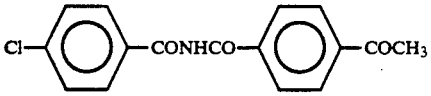
151)
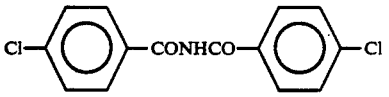
152)
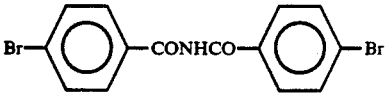
153)
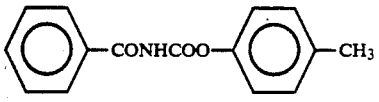
-continued
154)
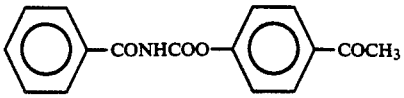
155)
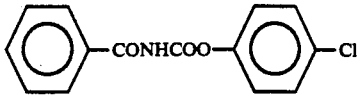
156)
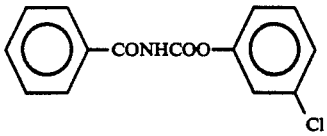
157)
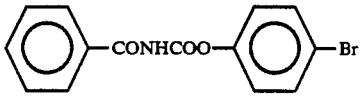
158)
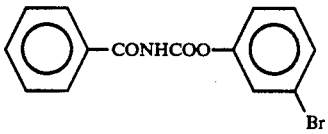
159)
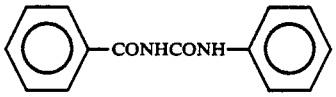
160)
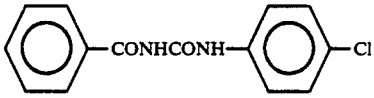
161)
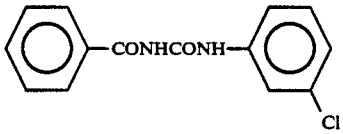
162)
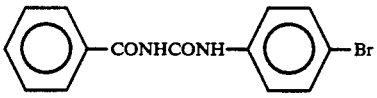
163)
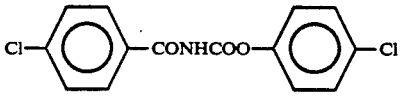
164)
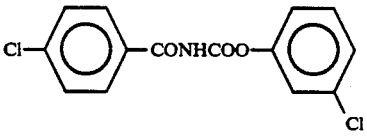
165)
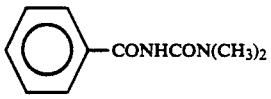

-continued

166)

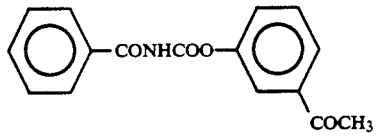

167)

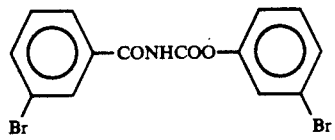

The methacryloylimido compounds of the formulae (I) to (V) can be prepared in accordance with the following reactions:

Also, the aromatic imido compounds of the formulae (VI) to (VIII) can be prepared in accordance with the following reactions:

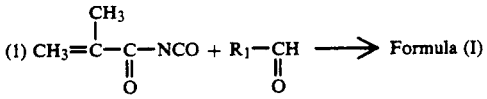

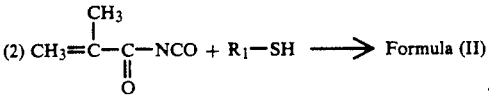

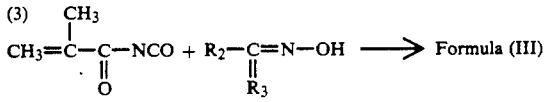

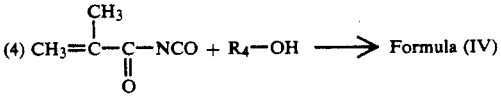

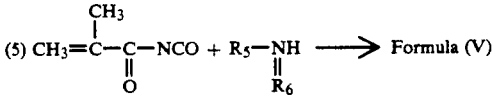

In the above formulae, $R_1$, $R_2$, $R_3$, $R_4$, $R_5$ and $R_6$ are as defined above.

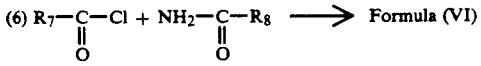

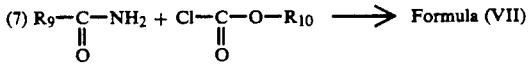

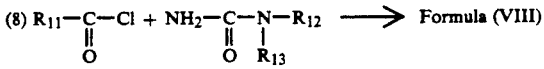

In the above-mentioned formulae, $R_7$, $R_8$, $R_9$, $R_{10}$, $R_{11}$, $R_{12}$ and $R_{13}$ are as defined above.

The specific color-developing agent of the present invention comprises one or two or more of the above-mentioned compounds of the formulae (I) to (VIII).

The thermosensitive colored image-forming layer optionally contains at least one conventional color-developing compound in addition to the specific color developing agent of the present invention, to further enhance the color-forming performance of the colored image-forming layer.

The conventional color developing compounds include color developing phenolic and organic acid compounds, and are preferably selected from the group consisting of 2,2-bis(4-hydroxyphenyl)propane(namely bisphenol A), 1,1-bis(4-hydroxyphenyl)-1-phenylethane, 1,4-bis[1-methyl-1-(4'-hydroxyphenyl)ethyl]benzene, 1,3-bis[1-methyl-1-(4'-hydroxyphenyl)ethyl]benzene, dihydroxydiphenylether(disclosed in JP-A-1-180,382), benzyl p-hydroxy-benzoate(disclosed in JP-A-52-140,483), bisphenol S, 4-hydroxy-4'-isopropoxydiphenylsulfone (disclosed in JP-A-60-13,852), 1,1-di-(4-hydroxyphenyl)cyclohexane, 1,7-di(4-hydroxyphenylthio)-3,5-dioxaheptane(disclosed in JP-A-59-52,694), and 3,3'-diallyl-4,4'-dihydroxydiphenylsulfone(disclosed in JP-A60-208,286).

The above-mentioned conventional color developing compounds can be employed alone or as a mixture of two or more thereof.

Preferably, the conventional color developing compounds are contained in an amount of 5 to 30% based on the total weight of the colored image-forming layer.

In the thermosensitive recording material of the present invention, the thermosensitive colored image-forming layer preferably further contains a colored image-stabilizing agent comprising at least one aromatic aziridine compound having at least one aziridinyl group.

The aziridinyl group, i.e., ethyleneimine group, is of the formula:

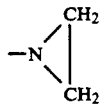

The aromatic aziridinyl compound usable for the colored image-stabilizing agent is preferably selected from the group consisting of 2,4-bis(1-aziridinylcarbonylamino)toluene, bis[4-(1-aziridinylcarbonylamino)-phenyl]methane, bis[3-chloro-4-(1-aziridinylcarbonylamino)phenyl]methane, 2,2-bis[4-(1-aziridinylcarbonyloxy)phenyl]propane, 1,4-bis(1-aziridinylcarbonyloxy)benzene and 1,4-bis(1-aziridinylcarbonyl)benzene.

The aziridinine compounds are used alone or as a mixture of two or more thereof.

The aziridinine compounds effectively enhance the resistance of the resultant colored images to oily and fatty substances, plasticizers, heat, and moisture, even immediately after the formation of the colored images.

The dye precursor usable for the colored image-forming layer of the present invention comprises at least one member selected from conventional triphenylmethane, fluoran and diphenylmethane leuco dyes, for example, 3-(4-diethylamino-2-ethoxyphenyl)-3-(1-ethyl-2-methylindole-3-il)-4-azaphthalide, crystal violet lactone, 3-(N-ethyl-N-isopentylamino)-6-methyl-7-anilinofluoran, 3-diethylamino-6-methyl-7-anilinofluoran, 3-diethylamino-6-methyl-7-(2',4'-dimethyl-anilino) fluoran, 3-(N-ethyl-N-p-toluidino)-6-methyl-7-anilinofluoran, 3-pyrrolidino-6-methyl-7-anilinofluoran, 3-dibutylamino-6-methyl-7-anilinofluoran, 3-(N-cyclohexyl-N-methylamino)-6-methyl-7-anilinofluoran, 3-diethylamino-7-(o-chloroanilino)fluoran, 3-diethylamino-7-(m-trifluoromethylanilino)fluoran, 3-diethylamino-6-methyl-7-chlorofluoran, 3-diethylamino-6-methylfluoran, 3-cyclohexylamino-6-chlorofluoran and 3-(N-ethyl-N-hexylamino)-6-methyl-7-(p-chloroanilino) fluoran.

The binder usable for the present invention preferably comprises at least one member selected from water-soluble polymeric materials, for example, various types of polyvinyl alcohol resins which have a different molecular weight from each other, starch and starch derivatives, cellulose derivatives, for example, methoxy cellulose, carboxymethyl cellulose, methyl cellulose and ethyl cellulose, sodium polyacrylate, polyvinyl pyrrolidine, acrylic acid amide-acrylic acid ester copolymers, acrylic acid amide-acrylic acid ester-methacrylic acid terpolymers, alkali salts of styrene-maleic anhydride copolymers, polyacrylic acid amide, sodium alginate, gelatine and casein, and water-insoluble polymeric materials, for example, polyvinyl acetate resins, polyurethane resins, styrene-butadiene copolymer resins, polyacrylic acid resins, polyacrylic acid ester resins, vinyl chloride-vinyl acetate copolymer resins, polybutyl acrylate, ethylene-vinyl acetate copolymer resins and styrene-butadiene-acrylic compound-terpolymer resins, used in the form of a latex.

In the thermosensitive colored image-forming layer of the present invention, the dye precursor is present in an amount of 5 to 20% by weight, the color developing agent is present in an amount of 10 to 40% by weight, and the binder is present in an amount of 5 to 20% by weight, based on the total dry weight of the colored image-forming layer.

When the content of the specific color developing agent of the present invention is less than 10%, the resultant colored image forming layer exhibits an unsatisfactory color-developing activity, and even if the content of the specific color developing agent is increased to more than 40%, the color developing activity of the resultant colored image-forming layer is saturated, and accordingly, is not further enhanced, and thus causes an economical disadvantage.

Also, in the thermosensitive colored image-forming layer of the present invention, the colored image-stabilizing agent is preferable present in an amount of 1 to 30% based on the total dry weight of the colored image-forming layer.

If the content of the colored image-stabilizing agent is less than 1%, the resultant colored image-stabilizing effect is sometimes unsatisfactory. Also, even if the colored image-stabilizing agent is used in an amount of more than 30%, no further enhancement of the colored image-stabilizing effect is obtained.

The thermosensitive colored image-forming layer of the present invention optionally further comprises a heat-fusible organic substance, usually referred to as a sensitizing agent, inorganic and organic pigments, antioxidants, for example, hindered phenol compounds, ultraviolet ray-absorbers, and waxes.

The sensitizing agent comprises at least one organic compound having a melting point of from 50° C. to 150° C., for example, phenyl 1-hydroxy-2-naphthoate (JP-A-57-191,089), p-benzyl-biphenyl (JP-A-60-82,382), benzylnaphthylether (JP-A-58-87,094), dibenzyl terephthalate (JP-A-58-98,285), benzyl p-benzyloxybenzoate (JP-A-57-201,691), diphenyl carbonate, ditolyl carbonate (JP-A-58-136,489), m-therphenyl (JP-A-57-89,994), 1,2-bis(m-tolyloxy)ethane (JP-A-60-56,588), 1,5-bis(p-methoxyphenoxy)-3-oxapentane (JP-A-62-181,183), oxalic acid diesters (JP-A-64-1,583) and 1,4-bis(p-tolyloxy) benzene (JP-A-2-153,783).

The inorganic and organic pigments usable for the present invention are preferably selected from inorganic fine particles of, for example, calcium carbonate, silica, zinc oxide, titanium dioxide, aluminum hydroxide, zinc hydroxide, barium sulfate, clay, anhydrous clay, talc, and surface-treated calcium carbonate and silica and organic fine particles of, for example, urea-formaldehyde resins, styrene-methacrylate copolymer resins and polystyrene resins.

The waxes usable for the present invention preferably comprise at least one member selected from, for example, paraffin waxes, carnauba wax, microcrystalline waxes, polyethylene waxes, amide type waxes, bisimide type waxes, higher fatty acid amide waxes, for example, stearic acid amide, ethylene-bis-stearoamide wax, higher fatty acid esters and metal salts, for example, zinc stearate, aluminum stearate calcium stearate and zinc oleate.

In the colored image-forming layer of the present invention, the sensitizing agent is preferably contained in an amount of 5 to 40% by weight, and the wax and organic or inorganic pigment are optionally contained in amounts of 2 to 20% by weight and 5 to 50% by weight, respectively, based on the total dry weight of the colored image-forming layer.

The sheet substrate usable for the present invention is not limited to a specific group of materials, and usually the sheet substrate comprises a member selected from fine paper sheets, coated paper sheet having a clay or latex-coated layer, cast-coated paper sheets, paper boards, plastic resin films, synthetic paper sheets comprising a plastic resin such as a polyolefin resin and a multi-layer structure, and laminated composite sheets. Preferably, the sheet substrate has a basis weight of 40 to 170 g/m$^2$.

The colored image-forming layer can be formed on a surface of a sheet substrate, by applying a coating liquid containing the above-mentioned components, and by drying and solidifying the coating liquid layer on the sheet substrate.

The colored image-forming layer is preferably present in a dry weight of from 1 to 15 g/m$^2$, more preferably 2 to 10 g/m$^2$.

In the present thermosensitive recording material, a protective layer and/or printed layer may be formed on the colored image-forming layer.

In the thermosensitive colored image-forming layer of the present invention, the colored image-forming layer containing, as a specific color developing agent, the specific compound of the formulae (I) to (VIII) exhibits a satisfactory color developing effect for practical use and has a high whiteness. Also, when the azirinine compound is contained in the colored image-forming layer in addition to the specific color developing compound of the present invention, the resultant colored images exhibit an excellent resistance to oily or fatty substances and to a plasticizer, even immediately after the formation of the colored images, and thus have a superior persistency for a long time.

EXAMPLES

The present invention will be further explained by the following specific examples, which are merely representative and do not in any way restrict the scope of the present invention.

EXAMPLE 1

A thermosensitive recording paper sheet was prepared by the following procedures.

| (1) Preparation of an aqueous dye precursor dispersion A in the following composition | |
|---|---|
| Component | Part by weight |
| 3-(N-isopentyl-N-ethylamino)-6-methyl-7-anilinofluoran | 20 |
| 10% aqueous solution of polyvinyl alcohol | 10 |
| Water | 70 |

The composition was dispersed in a sand grinder to an extent such that the resultant dispersed solid particles had an average size of 1 μm or less.

| (2) Preparation of an aqueous color-developing agent dispersion B in the following composition | |
|---|---|
| Component | Part by weight |
| Methacryloylimido compound of the formula 32 | 20 |
| 10% aqueous solution of polyvinyl alcohol | 10 |
| Water | 70 |

The composition was dispersed in a sand grinder to an extent such that resultant dispersed solid particles had an average size of 1 μm or less.

(3) PREPARATION OF A PIGMENT-COATED PAPER SHEET

A coating liquid was prepared by mixing an aqueous dispersion, prepared by dispersing 85 parts by weight of anhydrous clay available under the trademark of Ansilex, from Engelhard Corporation, in 320 parts by weight of water, with 40 parts by weight of an aqueous emulsion of a styrene-butadiene copolymer in a solid concentration of 50% by weight and 50 parts by weight of a 10% aqueous oxidized starch solution.

The coating liquid was coated on a surface of a fine paper sheet having a basis weight of 48 g/m$^2$, to form a coating layer having a dry weight of 7.0 g/m$^2$, whereby a coated paper sheet was obtained.

(4) FORMATION OF THERMOSENSITIVE COLORED IMAGE-FORMING LAYER

A coating liquid was prepared by evenly mixing 80 parts by weight of the aqueous dye precursor dispersion A, and 160 parts by weight of the aqueous color-developing agent dispersion B, with 30 parts by weight of a calcium carbonate pigment, 20 parts by weight of an aqueous 25% zinc stearate dispersion, 15 parts by weight of an aqueous 30% paraffin dispersion, and 120 parts by weight of an aqueous 10% polyvinyl alcohol solution, by agitating the mixture.

A surface of the pigment coated paper sheet was coated with the resultant coating liquid and dried. A thermosensitive colored image-forming layer was formed in a weight of 5.0 g/m$^2$, to provide a thermosensitive recording paper sheet.

The recording sheet was treated by a super calender, and the calendered surface of the recording sheet had a Bekk smoothness of 600 to 1000 seconds.

A specimen of the resultant thermosensitive recording sheet was subjected to a colored image-developing test in 64 lines by using a dynamic color-developing tester provided by modifying a thermosensitive facsimile printer, at a one line recording time of 10 m sec., at a scanning line density of 8×8 dot/mm, and with an applied energy of 0.54 mj/dot. The resultant black colored images were clear and had a high color density of 1.2 or more determined by Macbeth Reflection Color Density Tester RD-914 (trademarks).

The results of the above-mentioned tests are shown in Table 1.

EXAMPLE 2

A thermosensitive recording paper sheet was prepared by the same procedures as in Example 1 except that, in the preparation of the aqueous dispersion B, the compound of the formula 32 was replaced by the methacryloylimido compound of the formula 17.

The test results are shown in Table 1.

COMPARATIVE EXAMPLE 1

A thermosensitive recording paper sheet was prepared by the same procedures as in Example 1 except that, in the preparation of the aqueous color developing agent dispersion B, the compound of the formula 32 was replaced by 2,2-bis(4-hydroxyphenyl)propane(i.e., bisphenol A). The test results are shown in Table 1.

TABLE 1

| | Item | |
|---|---|---|
| Example No. | Color density of colored images (D) | Whiteness (%) of colored image-forming layer |
| Example 1 | 1.35 | 85.6 |
| 2 | 1.34 | 83.4 |
| Comparative Example 1 | 1.35 | 70.4 |

EXAMPLE 3

A thermosensitive recording paper sheet was prepared by the same procedures as in Example 1, with the following exceptions.

| (1) Additionally, an aqueous aziridinine compound dispersion C was prepared in the following composition. | |
|---|---|
| Component | Part by weight |
| Bis[4-(1-aziridinylcarbonylamino) phenyl]methane | 20 |
| 10% polyvinyl alcohol aqueous solution | 10 |
| Water | 70 |

The composition was dispersed in a sand grinder to an extent such that the resultant dispersed solid particles had an average size of 1 μm or less.

The above-mentioned aziridinine compound was of the chemical formula:

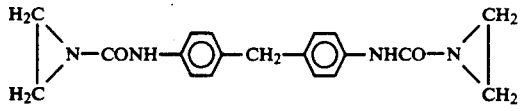

(2) FORMATION OF A THERMOSENSITIVE COLORED IMAGE-FORMING LAYER

A coating liquid was prepared by mixing 50 parts of the aqueous dispersion A and 100 parts of the aqueous dispersion B as mentioned in Example 1 and 100 parts by weight of the above-mentioned aqueous dispersion C, with 30 parts by weight of a calcium carbonate pigment dispersion, 20 parts by weight of an aqueous 25% aqueous zinc stearate dispersion, 15 parts by weight of an aqueous 30% paraffin dispersion and 120 parts by weight of an aqueous 10% polyvinyl alcohol solution, by agitating the mixture.

A surface of the pigment coated paper sheet was coated with the resultant coating liquid and the resultant coated layer was dried.

A thermosensitive colored image-forming layer was formed in a dry weight of 5.0 g/m$^2$, to provide a thermosensitive recording paper sheet.

The recording sheet was treated by a super calender, and the resultant calendered surface of the recording sheet had a Bekk smoothness of 600 to 1000 seconds.

A specimen of the resultant thermosensitive recording sheet was subjected to a colored image-developing test in 64 lines by using a dynamic color-developing tester provided by modifying a thermosensitive facsimile printer, at a one line recording time of 10 m sec., at a scanning line density of 8×8 dot/mm, and with an applied energy of 0.54 mj/dot. The resultant black colored images were clear and had a high color density of 1.0 or more determined by Macbeth Reflection Color Density Tester RD-914 (trademarks).

The color image-developed specimen was subjected within 30 minutes from the completion of the color image-developing procedure, to a salad oil resistance test in such a manner that a salad oil was applied to the colored image-developed surface of the specimen by using a cotton applicator, the salad oil-applied specimen was left to stand at room temperature for 30 minutes, and thereafter, the remaining colored images were evaluated by a naked eye observation.

The same test procedures as mentioned above were carried out, except that the salad oil was replaced by dioctyl phthalate to evaluate the resistance of the colored images to the plasticizer.

The results of the above-mentioned tests are shown in Table 2.

EXAMPLE 4

A thermosensitive recording paper sheet was prepared by the same procedures as in Example 3 except that, in the preparation of the aqueous color developing agent dispersion B, the compound of the formula 32 was replaced by the compound of the formula 17. The obtained black colored images had a color density of 1.32.

The test results are shown in Table 2.

EXAMPLE 5

A thermosensitive recording paper sheet was prepared by the same procedures as in Example 3 except that, in the preparation of the aqueous color developing agent dispersion B, the compound of the formula 32 was replaced by the compound of the formula 28. The resultant black colored images had a color density of 1.30.

The test results are shown in Table 2.

EXAMPLE 6

A thermosensitive recording paper sheet was prepared by the same procedures as in Example 3 except that, in the preparation of the aqueous aziridinine compound dispersion C, the bis[4-(1-aziridinylcarbonylamino)phenyl]methane was replaced by 2,4-bis(1-aziridinylcarbonylamino)toluene of the formula:

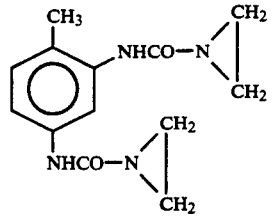

The resultant black colored images had a color density of 1.32.

The test results are shown in Table 2.

COMPARATIVE EXAMPLE 2

A thermosensitive recording paper sheet was prepared by the same procedures as in Example 3 except that, in the preparation of the aqueous color developing agent* dispersion B, the compound of the formula 32 was replaced by 2,2-bis(4-hydroxyphenyl)propane, namely bisphenol A.

The resultant black colored images had a color density of 1.31.

The test results are shown in Table 2.

COMPARATIVE EXAMPLE 3

The same procedures as in Comparative Example 1 were carried out, except that the resultant thermosensitive recording paper sheet specimen was subjected to the tests for the salad oil and plasticizer resistances of the colored images.

The results of the tests are shown in Table 2.

TABLE 2

| Example No. | | Item: Resistance of colored images to salad oil (*)$_1$ | Item: Resistance of colored images to dioctyl phosphate (*)$_1$ |
|---|---|---|---|
| Example | 3 | 3 | 3 |
| | 4 | 3 | 3 |
| | 5 | 3 | 3 |
| | 6 | 3 | 3 |
| Comparative Example | 2 | 2 | 1 |
| | 3 | 1 | 1 |

Note:
3 . . . Remaining colored images were clear
2 . . . Remaining colored images were dim
1 . . . Remaining colored images disappeared Table 1 clearly shows that the specific color developing agent of the present invention consisting of a methacryloylimido compound of the formulae (I) to (V) exhibited a satisfactory color developing performance comparable to a conventional typical color developing agent consisting of bisphenol A, and advantageously caused the resultant colored image-forming layer to exhibit a significantly high whiteness in comparison with the conventional colored image-forming layer.

Also, Table 2 clearly shows that the colored images formed on the colored image-forming layer of the present invention containing the aziridinine compound in addition to the specific color-developing agent exhibited an excellent resistance to the oily and fatty substances, and to the plasticizers, even immediately after the formation of the colored images.

EXAMPLE 7

A thermosensitive recording paper sheet was prepared by the following procedures.

| (1) Preparation of an aqueous dye precursor dispersion A in the following composition | |
|---|---|
| Component | Part by weight |
| 3-(N-isopentyl-N-ethylamino)-6-methyl-7-anilinofluoran | 20 |
| 10% aqueous solution of polyvinyl alcohol | 10 |
| Water | 70 |

The composition was dispersed in a sand grinder to an extent such that the resultant dispersed solid particles had an average size of 1 μm or less.

| (2) Preparation of an aqueous color-developing agent dispersion B in the following composition | |
|---|---|
| Component | Part by weight |
| Aromatic imido compound of the formula 101 | 20 |
| 10% aqueous solution of polyvinyl alcohol | 10 |
| Water | 70 |

The composition was dispersed in a sand grinder to an extent such that the resultant dispersed solid particles had an average size of 1 μm or less.

(3) PREPARATION OF A PIGMENT-COATED PAPER SHEET

A coating liquid was prepared by mixing an aqueous dispersion, prepared by dispersing 85 parts by weight of anhydrous clay available under the trademark of Ansilex, from Engelhard Corporation, in 320 parts by weight of water, with 40 parts by weight of an aqueous emulsion of a styrene - butadiene copolymer in a solid concentration of 50% by weight and 50 parts by weight of a 10% aqueous oxidized starch solution.

The coating liquid was coated on a surface of a paper sheet having a basis weight of 48 g/m$^2$, to a coating layer having a dry weight of 7.0 g/m$^2$, whereby a coated paper sheet was obtained.

(4) FORMATION OF THERMOSENSITIVE COLORED IMAGE-FORMING LAYER

A coating liquid was prepared by evenly mixing 80 parts by weight of the aqueous dye precursor dispersion A, and 160 parts by weight of the aqueous color-developing agent dispersion B, with 30 parts by weight of a calcium carbonate pigment, 20 parts by weight of an aqueous 25% zinc stearate dispersion, 15 parts by weight of an aqueous 30% paraffin dispersion, and 120 parts by weight of an aqueous 10% polyvinyl alcohol solution, by agitating the mixture.

A surface of the pigment coated paper sheet was coated with the resultant coating liquid and dried. A thermosensitive colored image-forming layer was formed in a weight of 5.0 g/m$^2$, to provide a thermosensitive recording paper sheet.

The recording sheet was treated by a super calender, and the calendered surface of the recording sheet had a Bekk smoothness of 600 to 1000 seconds.

A specimen of the resultant thermosensitive recording sheet was subjected to the same colored image-developing test in 64 lines as in Example 1. The resultant black colored images were clear and had a high color density of 1.2 or more determined by Macbeth Reflection Color Density Tester RD-914 (trademark).

Also, the reflectance of the non-color-developed portions of the specimen was measured by using a Hunter Whiteness Tester (trademark) with a blue filter.

The whiteness of the specimen was represented by the measured reflectance value.

The results of the above-mentioned tests are shown in Table 3.

EXAMPLE 8

A thermosensitive recording paper sheet was prepared by the same procedures as in Example 7 except that, in the preparation of the aqueous color developing agent dispersion B, the compound of the formula 101 was replaced by the compound of the formula 114. The obtained black colored images had a color density of 1.34.

The test results are shown in Table 3.

EXAMPLE 9

A thermosensitive recording paper sheet was prepared by the same procedures as in Example 7 except that, in the preparation of the aqueous dispersion B, the compound of the formula 101 was replaced by an aromatic imido compound of the formula 122.

The resultant black colored images had a color density of 1.34.

The test results are shown in Table 3.

COMPARATIVE EXAMPLE 4

A thermosensitive recording paper sheet was prepared by the same procedures as in Example 7 except that, in the preparation of the aqueous dispersion B, the compound of the formula 101 was replaced by 2,2-bis(4-hydroxyphenyl)propane, namely bisphenol A.

The resultant black colored images had a color density of 1.35.

The test results are shown in Table 3.

TABLE 3

| | Item | |
|---|---|---|
| Example | Color density (D) of colored images | Whiteness of colored image-forming layer (%) |
| Example 7 | 1.35 | 85.6 |
| 8 | 1.34 | 83.4 |
| 9 | 1.34 | 85.6 |
| Comparative Example 4 | 1.35 | 70.0 |

EXAMPLE 10

A thermosensitive recording paper sheet was prepared by the same procedures as in Example 7 with the following exceptions.

| (1) Additionally an aqueous aziridinine compound dispersion was prepared in the following composition. | |
|---|---|
| Component | Part by weight |
| Bis[4-(1-aziridinylcarbonylamino) phenyl]methane | 20 |
| 10% aqueous polyvinyl alcohol solution | 10 |
| Water | 70 |

The composition was dispersed in a sand grinder to an extent such that the resultant dispersed solid particles had an average size of 1 μm or less.

(2) FORMATION OF A THERMOSENSITIVE COLORED IMAGE-FORMING LAYER

A coating liquid was produced by mixing 50 parts by weight of the aqueous dye precursor dispersion and 100 parts of the aqueous color developing agent dispersion (B) of Example 7 and 100 parts by weight of the above-mentioned aqueous aziridinine compound dispersion C, with 30 parts by weight of a calcium carbonate pigment, 20 parts by weight of a 25% zinc stearate dispersion, 15 parts by weight of a 30% paraffin dispersion and 120 parts by weight of a 10% polyvinyl alcohol aqueous solution, by agitating the mixture.

The resultant coating liquid was applied to a surface of the pigment-coated paper sheet and dried, to provide a thermosensitive colored image-forming layer having a dry weight of 5.0 g/m$^2$. A thermosensitive recording paper sheet was obtained.

The resultant recording sheet was treated by a super calender to provide a smoothed surface thereof having a Bekk smoothness of 600 to 1000 seconds.

The resultant recording sheet was subjected to the same tests as mentioned in Example 3.

The obtained black colored images were clear and had a high color density of 1.0 or more, measured by a Macbeth Reflection Color Density Tester RD-914 (trademark).

The results of the salad oil and dioclyl phosphate resistance tests are shown in Table 4.

EXAMPLE 11

A thermosensitive recording paper sheet was prepared by the same procedures as in Example 10 except that, in the preparation of the color developing agent dispersion B, the compound of the formula 101 was replaced by an aromatic imido compound of the formula 114. The resultant black colored images had a color density of 1.29.

The test results are shown in Table 4.

EXAMPLE 12

A thermosensitive recording sheet was prepared by the same procedures as in Example 10 except that, in the preparation of the color developing agent dispersion B, the compound of the formula 101 was replaced by an aromatic imido compound of the formula 122. The resultant black colored images had a color density of 1.30.

The test results are shown in Table 4.

EXAMPLE 13

A thermosensitive recording paper sheet was obtained by the sam procedures as in Example 10 except that, in the preparation of the color developing agent dispersion, the compound of the formula 101 was replaced by an aromatic imido compound of the formula 126. The resultant black colored images had a color density of 1.28.

The test results are shown in Table 4.

EXAMPLE 1

A thermosensitive recording paper sheet was prepared by the same procedures as in Example 10 except that, in the preparation of the aziridinine compound dispersion C, the bis[4-(1-aziridinylcarbonylamino)-phenyl]methane was replaced by 2,4-bis(1-aziridinylcarbonylamino)toluene. The resultant black colored images had a color density of 1.30.

The test results are shown in Table 4.

COMPARATIVE EXAMPLE 5

A thermosensitive recording paper sheet was prepared by the same procedures as in Example 10 except that, in the preparation of the color developing agent dispersion B, the compound of the formula 101 was replaced by 2,2-bis(4-hydroxyphenyl)propane, i.e., bisphenol A.

The test results are shown in Table 4.

COMPARATIVE EXAMPLE 6

The same thermosensitive recording paper sheet as in Comparative Example 4 was subjected to the same salad oil and dioctyl phosphate resistance tests as in Example 3.

The test results are shown in Table 4.

TABLE 4

| Example No. | | Item: Resistance of colored images to salad oil (*)$_1$ | Item: Resistance of colored images to dioctyl phosphate (*)$_1$ |
|---|---|---|---|
| Example | 10 | 3 | 3 |
| | 11 | 3 | 3 |
| | 12 | 3 | 3 |
| | 13 | 3 | 3 |
| | 14 | 3 | 3 |
| Comparative Example | 5 | 2 | 1 |
| | 6 | 1 | 1 |

Note:
3 — Remaining colored images were clear.
2 — Remaining colored images were dim.
1 — Remaining colored images disappeared.

Table 3 clearly shows that the specific color developing agent of the present invention consisting of an aromatic imido compound of the formulae (VI) to (VIII) exhibited a satisfactory color developing performance comparable to a conventional typical color developing agent consisting of bisphenol A, and advantageously caused the resultant colored image-forming layer to exhibit a significantly high whiteness in comparison with the conventional colored image-forming layer.

Also, Table 4 clearly shows that the colored images formed on the colored image-forming layer of the present invention containing the aziridinine compound in addition to the specific color-developing agent exhibited an excellent resistance to the oily and fatty substances, and to the plasticizers, even immediately after the formation of the colored images.

We claim:

1. A thermosensitive recording material comprising:

a sheet substrate; and a thermosensitive colored image-forming layer formed on the sheet substrate and comprising a substantially colorless dye precursor, 10 to 40% based on the total dry weight of the thermosensitive colored image-forming layer of a color-developing agent reactive with the dye precursor upon heating to thereby develop a color, and a binder, the color-developing agent comprising at least one compound selected from the group consisting of the methacryloylimido compounds of the formulae (I) to (V).

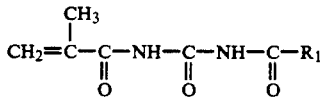

(I)

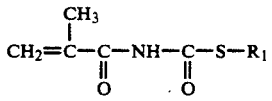

(II)

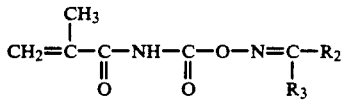

(III)

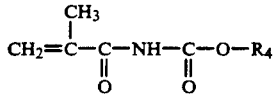

(IV)

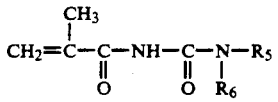

(V)

in which formulae (I) to (V), $R_1$ represents a member selected from the group consisting of a hydrogen atom and alkyl, aryl, aralkyl, alkenyl and cycloalkyl groups;

$R_2$ and $R_3$ respectively and independently from each other represent a member selected from the group consisting of a hydrogen, and alkyl, aryl, aralkyl, alkenyl and acetyl, except that when one of $R_2$ and $R_3$ represents a hydrogen, the other $R_2$ and $R_3$ represents a member other than the hydrogen, which $R_2$ and $R_3$ may be formed together with a carbon atom bonded thereto into a cyclic structure;

$R_4$ represents a member selected from the group consisting of alkyl, aryl, aralkyl, alkenyl, piperidino, succinimido, ρ-benzoylphenyl,

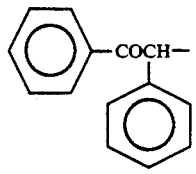

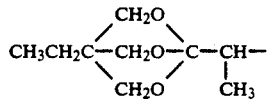

and

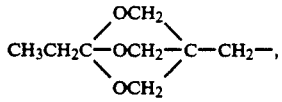

and $R_5$ and $R_6$ respectively and independently from each other represent a member selected from the group consisting of a hydrogen, alkyl, aryl, aralkyl, alkenyl, cycloalkyl, thiazolinyl and morpholino, which $R_5$ and $R_6$ may be formed together with a nitrogen atom bonded thereto into a cyclic structure selected from the group consisting of

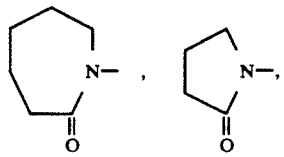

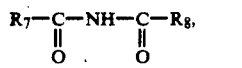

(VI)

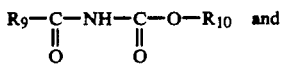

(VII)

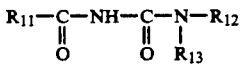

(VIII)

in which formulae (VI) to (VIII), $R_7$, $R_9$ and $R_{11}$ respectively and independently from each other represent a member selected from the group consisting of unsubstituted aromatic cyclic groups and substituted aromatic cyclic groups having at least one substituent selected from the group consisting of alkyl, alkoxyl, acyl, aryl, nitro and carboxylic groups and halogen atoms;

$R_8$, $R_{10}$ and $R_{12}$ respectively and independently from each other represent a member selected from the group consisting of unsubstituted or substituted alkyl, aryl, aralkyl and alkenyl groups and each of said substituted group having at least one substituent selected from the group consisting of alkyl, alkoxyl, acyl, nitro and halogen; and $R_{13}$ represents a member selected from the group consisting of hydrogen, unsubstituted or substituted alkyl, aryl, aralkyl and alkenyl groups, each of said substituted groups having at least one substituent selected from the group consisting of alkyl, alkoxyl, acyl, nitro and halogen.

2. The thermosensitive recording material as claimed in claim 1, wherein the methacryloylimido compounds of the formulae (I) to (V) are selected from the group consisting of the compounds of the formulae 1) to 36):

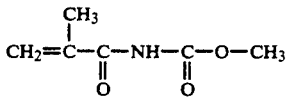

1)

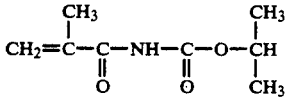

2)

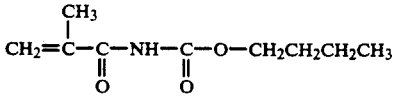

3)

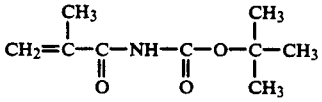

4)

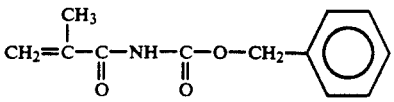

5)

-continued
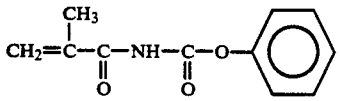
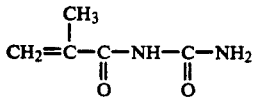
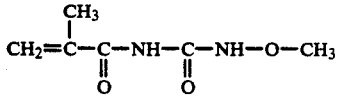
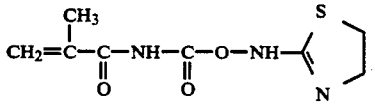
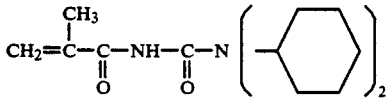
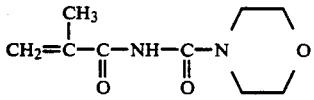
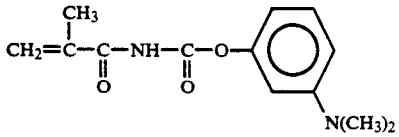
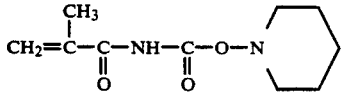
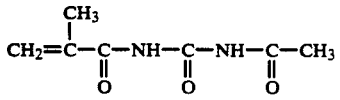
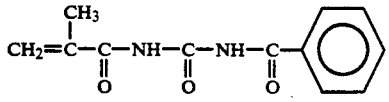
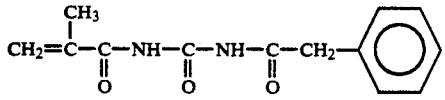
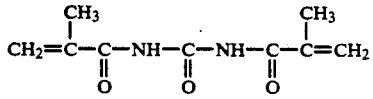
6)
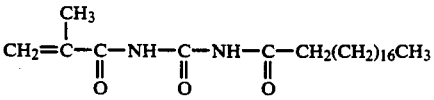
7)
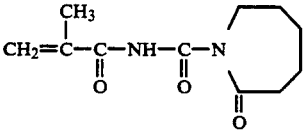
8)
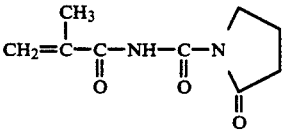
9)
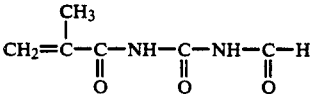
10)
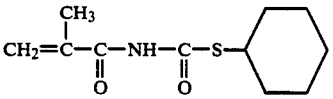
11)
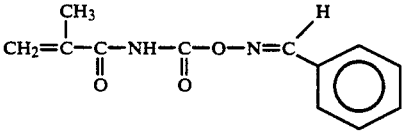
12)
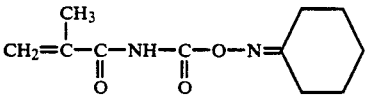
13)
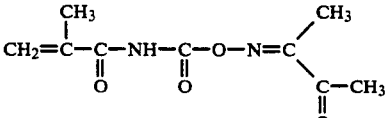
14)
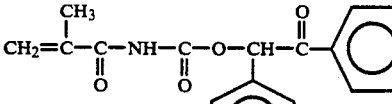
15)
16)
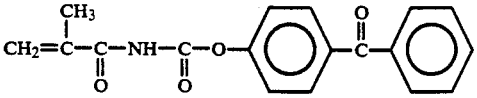
17)
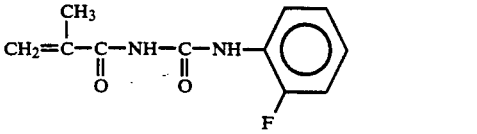
18)
19)
20)
21)
22)
23)
24)
25)
26)
27)
28)
29)

-continued
30)
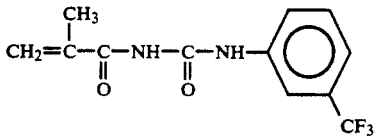
31)
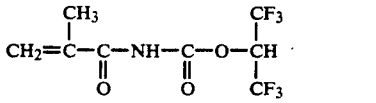
32)
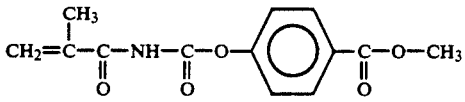
33)
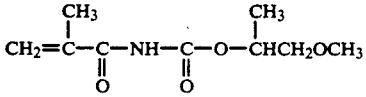
34)
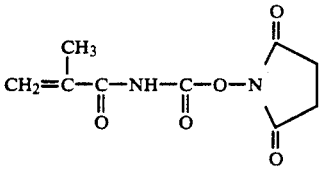
35)
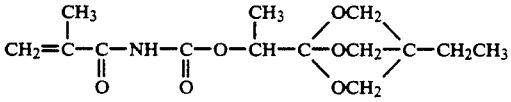
and
36)
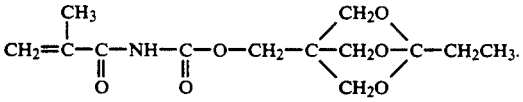
3. The thermosensitive recording material as claimed in claim 1, wherein the aromatic imide compounds of the formulae (VI) to (VIII) are selected from the group consisting of the compounds of the formulae 101) to 167):
101)
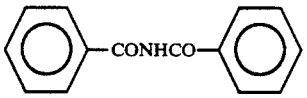
102)
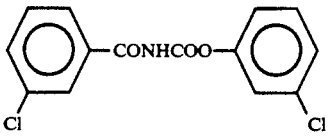
103)
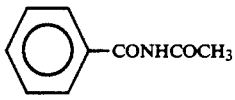
104)
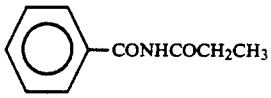
-continued
105)
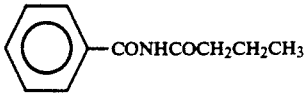
106)
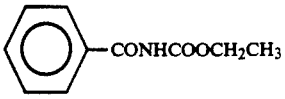
107)
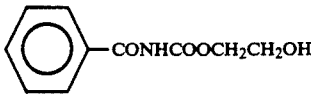
108)
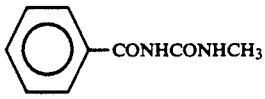
109)
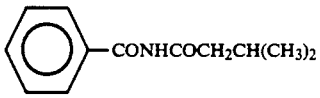
110)
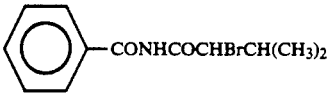
111)
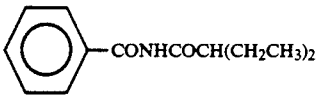
112)
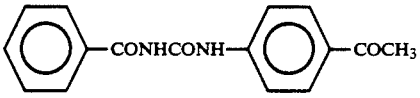
113)
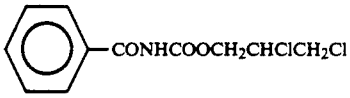
114)
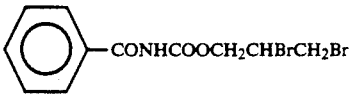
115)
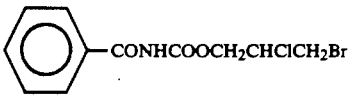
116)
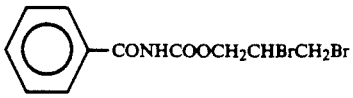
117)
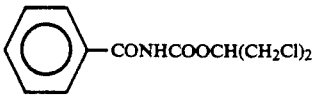
118)
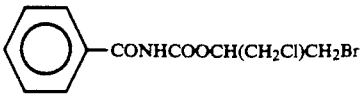

-continued
119)
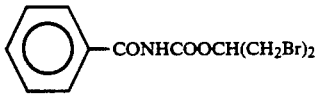
120)
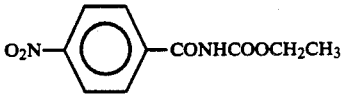
121)
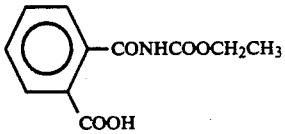
122)
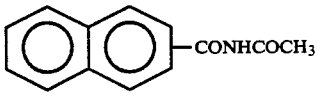
123)
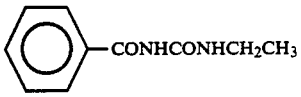
124)
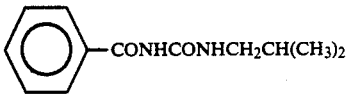
125)
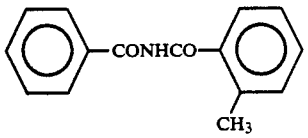
126)
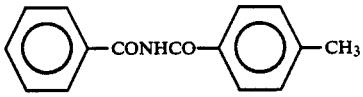
127)
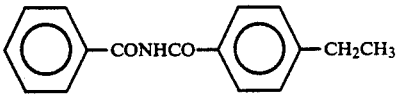
128)
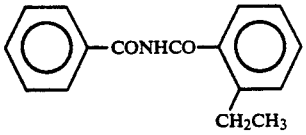
129)
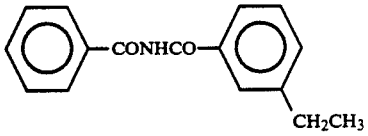
130)
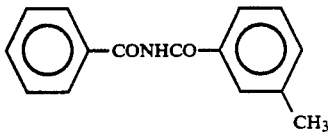
-continued
131)
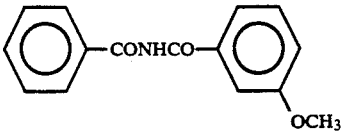
132)
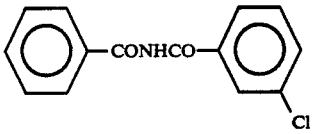
133)
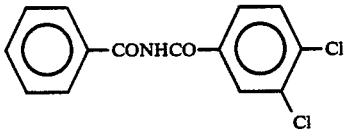
134)
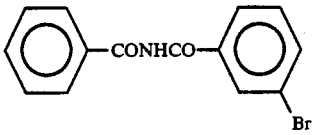
135)
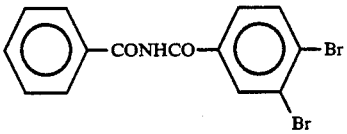
136)
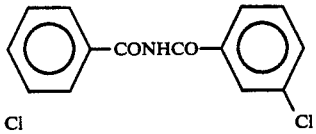
137)
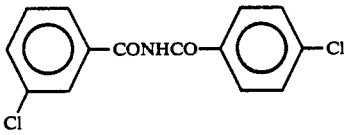
138)
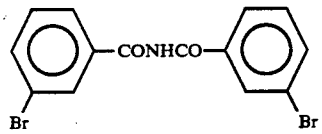
139)
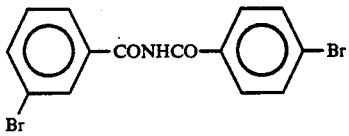
140)
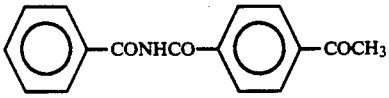
141)
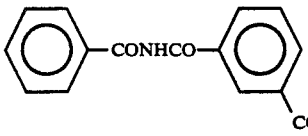

-continued
142)
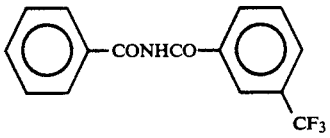
143)
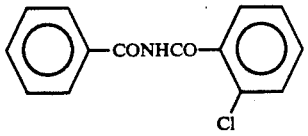
144)
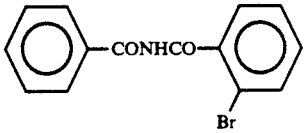
145)
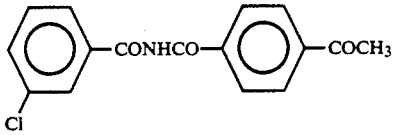
146)
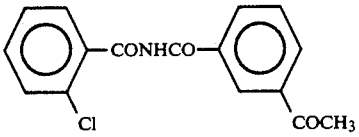
147)
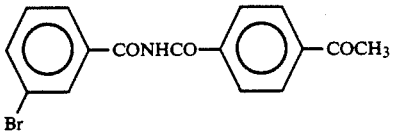
148)
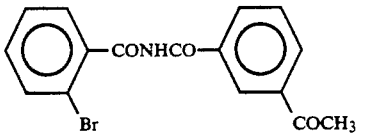
149)
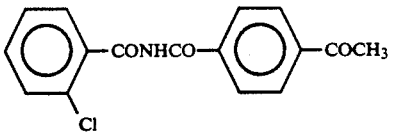
150)
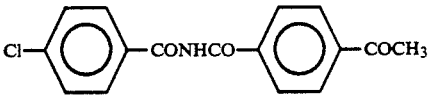
151)
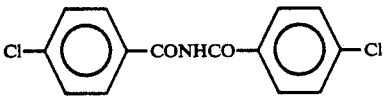
152)
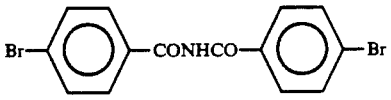
-continued
153)
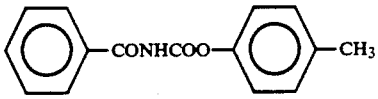
154)
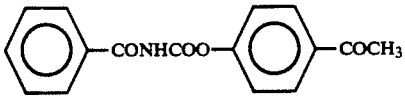
155)
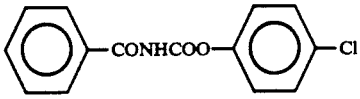
156)
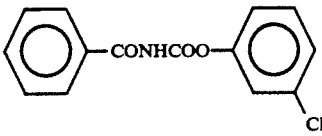
157)
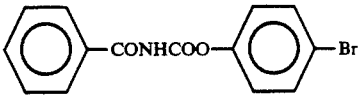
158)
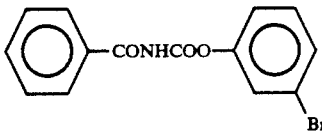
159)
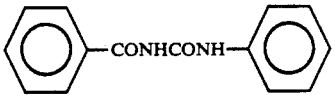
160)
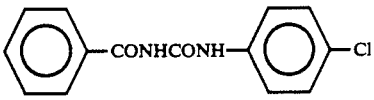
161)
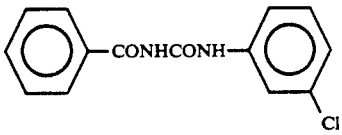
162)
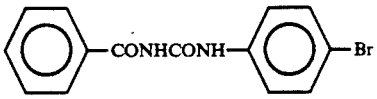
163)
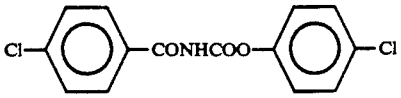
164)
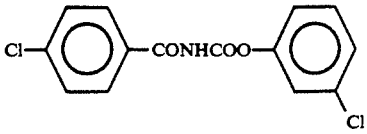

-continued

165)

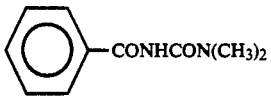

166)

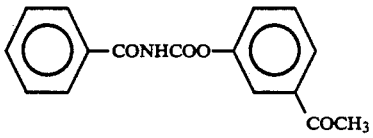

and

-continued

167)

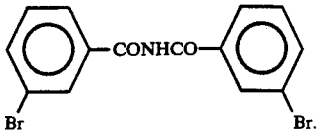

4. The thermosensitive recording material as claimed in claim 1, wherein the thermosensitive colored image-forming layer further contains a colored image-stabilizing agent comprising at least one aziridine compound having at least one aziridinyl group.

5. The thermosensitive recording material as claimed in claim 4, wherein the aziridine compound is selected from the group consisting of 2,4-bis(1-aziridinylcarbonylamino)toluene, bis[4-(1-aziridinylcarbonylamino)-phenyl]methane, bis[3-chloro-4-(1-aziridinylcarbonylamino)phenyl]methane, 2,2-bis[4-(1-aziridinylcarbonyloxy)phenyl]propane, 1,4-bis(1-aziridinylcarbonyloxy)benzene, and 1,4-bis(1-aziridinylcarbonyl)-benzene.

6. The thermosensitive recording material as claimed in claim 4, wherein the colored image-stabilizing agent is present in an amount of 1 to 30% based on the total dry weight of the thermosensitive colored image-forming layer.

* * * * *